US009200513B2

(12) United States Patent
Bednarz et al.

(10) Patent No.: US 9,200,513 B2
(45) Date of Patent: Dec. 1, 2015

(54) METHOD FOR MOUNTING A RANGING ARM ON A BODY OF A LONGWALL SHEARER LOADER

(75) Inventors: Ryszard Bednarz, Katowice (PL); Pawel Gwiaździński, Żernica (PL); Lukasz Gonsior, Marklowice (PL); Marek Olszański, Sosnowiec (PL)

(73) Assignees: Famur Spółka Akcyjna, Katowice (PL); Fumur Institute Sp. z o.o, Katowice (PL)

( * ) Notice: Subject to any disclaimer, the term of this patent is extended or adjusted under 35 U.S.C. 154(b) by 480 days.

(21) Appl. No.: 13/509,260

(22) PCT Filed: Nov. 2, 2010

(86) PCT No.: PCT/PL2010/000109

§ 371 (c)(1),
(2), (4) Date: Jul. 30, 2012

(87) PCT Pub. No.: WO2011/059349

PCT Pub. Date: May 19, 2011

(65) Prior Publication Data

US 2012/0284999 A1 Nov. 15, 2012

(30) Foreign Application Priority Data

Nov. 10, 2009 (PL) ..... 389529

(51) Int. Cl.
*E21C 27/02* (2006.01)
*E21C 31/08* (2006.01)

(52) U.S. Cl.
CPC ..... *E21C 31/08* (2013.01); *Y10T 29/49959* (2015.01)

(58) Field of Classification Search
CPC ..... E21C 31/08
USPC ..... 299/42, 53
See application file for complete search history.

(56) References Cited

U.S. PATENT DOCUMENTS 1,979,266 A 11/1934 Holmes
3,282,627 A 11/1966 Arndt (Continued)

FOREIGN PATENT DOCUMENTS

DE 3420548 A1 12/1985
GB 1506974 * 4/1978

(Continued)

OTHER PUBLICATIONS

International Search Report for PCT/PL2010/000109, mailed Aug. 24, 2011.

(Continued)

*Primary Examiner* — John Kreck
(74) *Attorney, Agent, or Firm* — Roberts Mlotkowski Safran & Cole, P.C.

(57) ABSTRACT

The method for mounting a ranging arm on a body of a longwall shearer loader characterized by the fact that the shearer's ranging arm (7) is pivotally connected through the eyes (9) and at least one pin (3) with the eyes of the articulated joint (6) located from the side wall side in the bottom part of the shearer's body (5) outside of the chain conveyor (11). The axis of the pin or pins (3) is situated below the axis of the motor (12) of the shearer's ranging arm (7). The hydraulic cylinder (4) is pivotally connected with the eyes (8) of the shearer's ranging arm (7) located between the eyes of the articulated joint (6) with a pin (2), the axis of which is situated above the axis of the motor (12) of the shearer's arm (7). The hydraulic cylinder (4) is pivotally connected with the shearer's body (5) with a pin (1), the axis of which is situated below the axis of the motor (12) of the shearer's arm (7) and below the axis of the feed drive shaft (10). The axis of the pin (1) is situated at the same height as the axis of the pin or pins (3) connecting the shearer's arm (7) with the eyes of the articulated join (6). The hydraulic cylinder (4) is located between the axis of the feed drive shaft (10) and the pin of pins (3) connecting the shearer's ranging arm (7) with the eyes of the articulated joint (6).

4 Claims, 3 Drawing Sheets

(56) References Cited

U.S. PATENT DOCUMENTS

| | | | | |
|---|---|---|---|---|
| 3,333,895 | A | 8/1967 | Anderson | |
| 3,727,801 | A | 4/1973 | Caridis et al. | |
| 3,844,629 | A | 10/1974 | Haines | |
| 3,876,252 | A | 4/1975 | Cilles | |
| 4,082,361 | A | 4/1978 | Lanfermann | |
| 4,435,018 | A * | 3/1984 | Parrott | 299/43 |
| 5,913,403 | A | 6/1999 | Merten et al. | |
| 5,964,507 | A | 10/1999 | Blackstock | |
| 2012/0279831 | A1 | 11/2012 | Bednarz et al. | |

FOREIGN PATENT DOCUMENTS

| | | | |
|---|---|---|---|
| GB | 2047774 | A | 12/1980 |
| GB | 2088445 | A | 6/1982 |
| PL | 41640 | B1 | 3/1985 |
| PL | 41640 | | 12/1985 |
| PL | 170568 | | 11/1994 |
| PL | 170568 | B1 | 11/1994 |
| PL | 172261 | | 8/1995 |
| PL | 172261 | B1 | 8/1995 |
| PL | 188549 | B1 | 5/2000 |
| PL | 180563 | B1 | 2/2001 |
| PL | 199858 | B1 | 7/2004 |
| PL | 188549 | B1 | 2/2005 |
| PL | 199858 | B1 | 11/2008 |

OTHER PUBLICATIONS

International Search Report of PCT/PL2010/000108 dated Aug. 24, 2011 (co-pending application).

* cited by examiner

METHOD FOR MOUNTING A RANGING ARM ON A BODY OF A LONGWALL SHEARER LOADER

CROSS-REFERENCE TO RELATED APPLICATIONS

The present Application is a U.S. National Phase Application of International Application PCT/PL2010/000109 filed on Nov. 2, 2010, which claims priority from Polish Application No. P-389529 filed on Nov. 10, 2009, both of which are hereby incorporated by reference in their entirety into the present Application.

The subject of the invention is the method for mounting a ranging arm on a body of a longwall shearer loader.

A shearer's ranging arm mechanism has been described in the Polish description of the utility model No. 41640. The mechanism includes a rocker arm in form of a beam with bent ends, whereas the bent end from the side of a hydraulic cylinder has a tip pointing to the outside and parallel to the main central part of the rocker arm. Such a rocker arm is mounted in the area above the travel in such a manner as to locate it next to the body and parallel to it.

A cutter-loader ranging arm mechanism has also been described in the Polish description of the patent No. 199858. In the case of such a mechanism, a guide is mounted on a cutter-loader body from the bottom side, which is open from both the cylinder side as well as the arm side. The guide is closed from below with a detachable cover. Inside the guide, there is a pilot installed in such a manner as to enable its slide motion. The pilot moves along interchangeable (detachable) glide bars mounted on the guide. On the one side, the pilot is connected through a self-aligning bearing with a piston rod of a hydraulic cylinder of which is also fixed through a self-aligning bearing to the shearer's body. On the other side, the pilot is connected with the eye of the shearer's ranging arm through a rocker. The rocker is connected with the pilot and the eye of the shearer's ranging arm also through self-aligning bearings.

The method for mounting a ranging arm on a body of a longwall shearer loader in line with the invention is characterised by the fact that the shearer's ranging arm is pivotally connected through the eyes and at least one pin with the eyes of the articulated joint located from the side wall side in the bottom part of the shearer body outside of the chain conveyor.

The axis of the pin or the pins connecting the shearer's ranging arm with the eyes of the articulated joint is situated below the axis of the motor of the shearer's arm. The hydraulic cylinder is pivotally connected with the eyes of the shearer's ranging arm located between the eyes of the articulated joint with a pin, whose axis is situated above the axis of the engine of the shearer's arm.

The hydraulic cylinder is pivotally connected with the shearer's body with a pin, whose axis is situated below the axis of the motor of the shearer's arm and below the axis of the feed drive shaft. The axis of the pin is situated at about the same height as the axis of the pin or pins connecting the shearer's ranging arm with the eyes of the articulated joint. The hydraulic cylinder is located between the axis of the feed drive shaft and the pin or pins connecting the shearer's ranging arm with the eyes of the articulated joint.

The method for mounting a ranging arm on a body of a longwall shearer loader described as the invention is intended for use in the case of very low shearers. This method enables easy drive transmission to the caving side in restricted space (overall dimensions) conditions.

BRIEF DESCRIPTION OF THE DRAWINGS

An example of the subject of the invention has been presented in the drawing, wherein.

Figure 1:
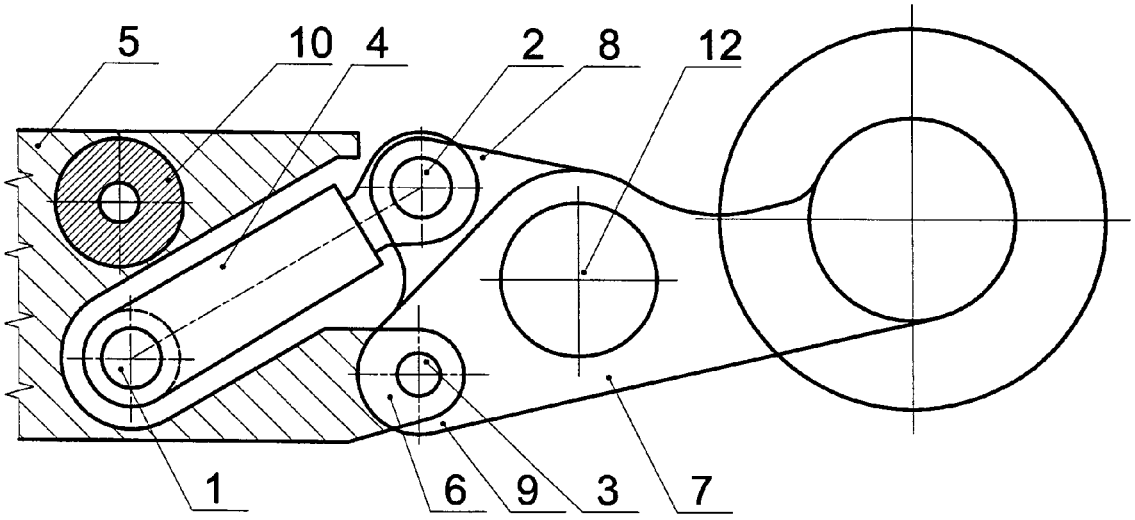
FIG. 1 indicates the method for mounting a ranging arm on a body of a longwall shearer loader as seen from the side.
Figure 2:
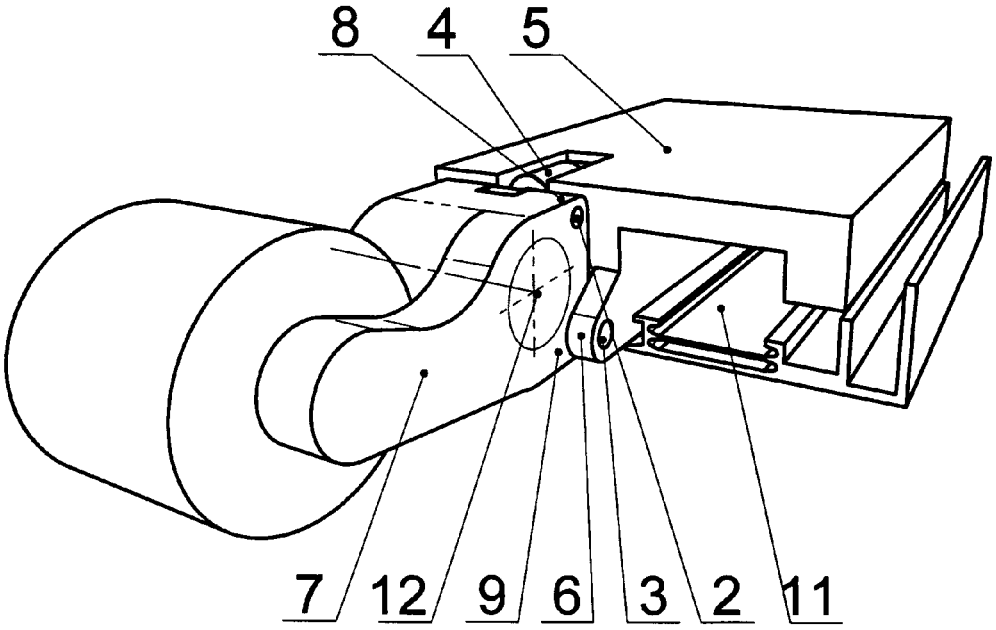
FIG. 2 indicates the method for mounting a ranging arm on a body of a longwall shearer loader as seen in an axonometric view.
Figure 3:
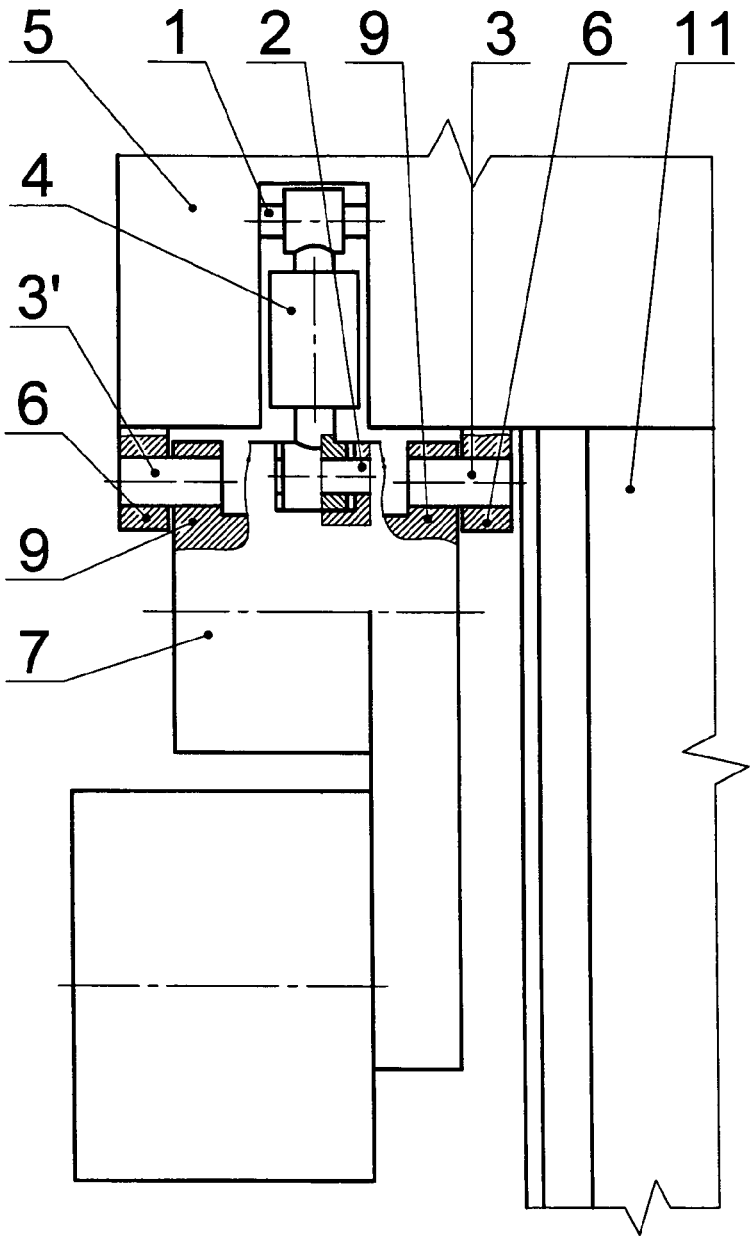
FIG. 3 indicates the method for mounting a ranging arm on a body of a longwall shearer loader as seen from above.

The shearer's ranging arm 7 is pivotally connected through the eyes 9 and at least one pin 3 with the eyes of the articulated joint 6 located from the side wall side in the bottom part of the shearer's body 5 outside of the armoured face conveyor 11.

The axis of the pin or pins 3 connecting the shearer's ranging arm 7 with the eyes of the articulated joint 6 is situated below the axis of the motor 12 of the shearer's arm 7. The hydraulic cylinder 4 is pivotally connected with the eyes 8 of the shearer's ranging arm 7 located between the eyes of the articulated joint 6 with a pin 2, the axis of which is situated above the axis of the motor 12 of the shearer's arm 7.

The hydraulic cylinder 4 is pivotally connected with the shearer's body 5 with a pin 1, the axis of which is situated below the axis of the motor 12 of the shearer's arm 7 and below the axis of the feed drive shaft 10.

The axis of the pin 1 is situated at the same height as the axis of the pin or pins 3 connecting the shearer's ranging arm 7 with the eyes of the articulated joint 6. The hydraulic cylinder 4 is located between the axis of the feed drive shaft 10 and the pin or pins 3 connecting the shearer's ranging arm 7 with the eyes of the articulated joint 6.

The invention claimed is:

1. A longwall shearer loader, comprising:

a shearer body having an articulating joint eyelet located in a bottom portion of the body;

a ranging arm having first and second ends, said first end disposed inside the shearer body and having upper and lower sets of eyelets, wherein the lower set of eyelets are pivotally connected to the articulating joint eyelet to provide a pivot point for the ranging arm within the shearer body;

an armoured face conveyor positioned outside of the bottom portion of the shearer body; and a hydraulic cylinder having a first end pivotally connected within the shearer body and a second end pivotally connected to the upper set of eyelets of the ranging arm.

2. The longwall shearer loader of claim 1, wherein said ranging arm has a motor disposed between said first and second ends thereof.

3. The longwall shearer loader of claim 1, wherein the pivotal connection of the first end of the hydraulic cylinder comprises a pin connected within a bottom portion of the shearer body, said pin passing through an eyelet on the first end of the hydraulic cylinder.

4. The longwall shearer loader of claim 1, wherein the armoured face conveyor is a chain conveyor.

* * * * *

UNITED STATES PATENT AND TRADEMARK OFFICE

CERTIFICATE OF CORRECTION

PATENT NO. : 9,200,513 B2
APPLICATION NO. : 13/509260
DATED : December 1, 2015
INVENTOR(S) : Ryszard Bednarz et al.

It is certified that error appears in the above-identified patent and that said Letters Patent is hereby corrected as shown below:

Title Page, item (73) Assignees: should read as follows:

Famur Spolka Akcyjna, Katowice, Poland (PL)
Famur Institute Sp. z o.o., Katowice, Poland (PL)

Signed and Sealed this
Twenty-ninth Day of March, 2016

Michelle K. Lee

Michelle K. Lee
*Director of the United States Patent and Trademark Office*